United States Patent [19]

Johnson

[11] 4,448,109

[45] May 15, 1984

[54] AUTOMATIC OR SEMI-AUTOMATIC FIREARM

[76] Inventor: James H. Johnson, 818 S. Willow Ave., Tampa, Fla. 33606

[21] Appl. No.: 311,090

[22] Filed: Oct. 13, 1981

[51] Int. Cl.[3] ..... F41D 11/02

[52] U.S. Cl. ..... 89/141; 89/143

[58] Field of Search ..... 89/141, 142, 143, 145, 89/148, 149; 42/69 B

[56] References Cited

U.S. PATENT DOCUMENTS

| | | | |
|---|---|---|---|
| 834,753 | 10/1906 | Reifgraber | 89/148 |
| 1,786,536 | 12/1930 | Holek | 89/148 |
| 1,980,874 | 11/1934 | Nickl | 89/141 |

*Primary Examiner*—Stephen C. Bentley

*Attorney, Agent, or Firm*—Stefan Stein

[57] ABSTRACT

A firearm including a basic action system having differential recoil, blow-back operation with moving barrel and a firing mechanism for use in conjunction with the basic action system of the invention or any other type of system operable to fire from a closed-bolt position and an open-bolt position. The basic action system utilizes a single spring which positively positions the bolt and barrel for semi-automatic, closed-bolt firing, while also providing the necessary spring and positioning action for open-bolt, differential recoil, blow-back operation. The firing mechanism of the invention provides for semi-automatic fire from the closed-bolt position, and for full automatic fire from the open bolt position, with a selector to permit selection by the gunner.

9 Claims, 10 Drawing Figures

AUTOMATIC OR SEMI-AUTOMATIC FIREARM

BACKGROUND AND SUMMARY OF THE INVENTION

This invention relates to a firearm of the automatic or semi-automatic type. More particularly, this invention relates to a reciprocating bolt action of the firearm which permits the firearm to be fired from an open bolt or a closed bolt position. This invention further relates to a trigger mechanism which permits the firearm to be fired from the closed bolt position in the semi-automatic mode, and from the open bolt position in the fully automatic mode.

It is well-known that the recoil of any firearm increases as the firearm, or that part of it which recoils, is decreased in weight or the power of the ammunition that is fired is increased. In order to achieve a stable, lightweight firearm, the gun designer is faced with the dilemma of either increasing the weight of the firearm, or decreasing the power of the ammunition.

Several systems have been developed to mitigate the recoil effect of firearms firing powerful ammunition. One such system is known as the differential recoil system. U. S. Pat. No. 1,144,185 issued to Rheinhold Becker teaches a firearm in which the barrel is affixed to the frame of the weapon. A simple blowback type of bolt is used, which is not mechanically locked to the barrel at any time. The weapon is fired from the open bolt position, and the cartridges are fired just before reaching the fully forward position in the chamber. The forward motion of the cartridge case and the blowback bolt is then first arrested by the impulse caused by firing, and then accelerated to the rear, providing differential recoil. Unfortunately, this type of weapon requires the use of a special over-length chamber, and a specially shaped cartridge case which permits the front portion of the bolt to enter the chamber with the cartridge. Moreover, the cartridge case must be heavily lubricated to permit the cartridge case and the bolt to move within the chamber during the period when the propellant gas pressure is high.

In U. S. Pat. No. 3,738,044 issued to Russell Robinson, another type of differential recoil system is disclosed. Specifically, with a single spring serving for both bolt and barrel, the barrel is allowed to move slightly forward when impacted by the closing bolt, thereby obviating the need for a special over-length firing chamber. In practice, it was found that the fullest advantages of differential recoil were not obtained due to the fact that a considerable amount of kinetic energy was expended in impacts of the moving parts on the frame of the weapon. Additionally, the patent disclosed means which permitted only open bolt firing. Closed bolt firing is impractical because the particular arrangement of the spring would not positively position the bolt and barrel, as is required in closed bolt firing.

Finally, U. S. Pat. No. 4,019,423 issued to me and French Pat. No. 911,440 teach firearms which operate in a similar manner to that of the Robinson patent but which utilize separate springs for the bolt and the barrel. In both of these patents, the firearm included a spring loaded, reciprocating barrel which is driven forwardly upon being impacted by the closing bolt. The cartridge was then fired during the forward movement of the bolt and barrel. Unfortunately, these patents also suffered from the inability to be fired from a closed bolt position. The disclosure of each of the abovementioned patents is hereby incorporated by reference in the specification.

It is an object of the present invention to provide a firearm which overcomes the disadvantages of the prior art firearms. More particularly, the present invention comprises a basic action system having differential recoil, blowback operation, with moving barrel. Specifically, the arrangement of the bolt, barrel, and associated components of the basic action system utilizes a single spring which positively positions the bolt and barrel for semi-automatic, closed bolt firing (no differential recoil effect possible in this mode), while also providing the necessary spring and positioning action for open bolt, differential recoil, blowback operation.

The present invention also comprises a firing mechanism which may be utilized in conjunction with the basic action system of the invention, or any other type of system operable to fire from a closed bolt position and an open bolt position. Specifically, the firing mechanism of the invention provides for semi-automatic fire from the closed bolt position, and for full automatic fire from the open bolt position, with separate means being provided to permit selection by the gunner. An arrangement is provided in which the trigger is in front of the grip, the magazine passes through the grip, and the hammer is behind the magazine, with the trigger being connected to the hammer by a link (passing to one side of the magazine) having both longitudinal and vertical motion. The hammer is operable, in both firing modes, to fire the weapon. In the full automatic, open bolt mode, the hammer functions as a sear to hold the bolt rearward until the trigger is pulled. Means are provided in which the interaction of the link and the bolt forward motion acts to release the hammer to fall and fire the weapon at or shortly after the bolt has closed in the fully automatic mode, and which, in the semi-automatic mode, insures that the hammer cannot fall until the bolt is closed.

Many other objects and purposes of the invention will be clear from the following detailed description of the preferred embodiment.

DETAILED DESCRIPTION OF THE PREFERRED EMBODIMENT

Basic Action System

Referring to FIG. 1, it is seen that the firearm 10 includes a receiver 12, grip 14, trigger 16 and trigger guard 18, a slidable, reciprocating barrel 20, and cartridge magazine 22 inserted through the grip 14. A bolt 24 is slidably positioned within the receiver 12 which rams a cartridge from the magazine 22 into the firing chamber 26 of the barrel 20.

The basic action system 30 of the invention comprises various components which allow the firearm 10 to be operated from a closed bolt or an open bolt position. The trigger mechanism which controls the operation of the bolt may comprise a standard design, or comprise the trigger mechanism of the invention which will be described in detail hereinafter.

The basic action system 30 of the invention comprises a guide rod 32 which is positioned within the longitudinal length of the receiver 12. The forward terminal end of the guide rod 32 is connected to a lug 36 which extends from the barrel 20. Preferably, the forward terminal end 34 is rigidly connected to the lug 36 by a fastener 38 such as a rivet. An abutment 40 extends from the inside surface of the receiver 12 in a blocking position with the lug 36 such that the lug 36 engages the abutment 40 when the barrel 20 is slid rearwardly within the receiver 12. A collar 42 is slidably disposed about the guide rod 32. The collar 42 comprises a forward, minor diameter portion 44 and a rearward, major diameter portion 46. A helical compression spring 48 is concentrically positioned about the guide rod 32 between the collar 42 and the rearward terminal end 50 of the guide rod 32. A retaining means such as a stop 52 is connected to the rearward terminal end 50 of the guide rod 32 to rigidly secure the spring 48 between the collar 42 and the rearward terminal end 50 of the guide rod 32.

The collar 42, guide rod 32, and the spring 48 are slidably positioned through a hole 54 in the bolt 24. The hole 54 includes a step portion 56 which mates with the major diameter portion 46 of the collar 42 to block the movement of the collar 42 through the hole 54. The length of the minor diameter portion 44 of the collar 42 and the position of the step portion 56 in the hole 54 are selected such that the bolt 24 will be in firm engagement with the end of the barrel 20 when the lug 36 is seated against the abutment 40. A cocking handle 58, or other means is connected to the bolt 24 for cocking the bolt 24 from the closed bolt position to an open bolt position.

Referring to FIG. 2, it is seen that when the bolt 24 is released by the sear 66 of the trigger mechanism, the bolt 24 is forced forwardly within its track by means of the spring 48. The bolt 24 rams a cartridge 68 from the magazine 22 into the firing chamber 26 of the barrel 20. Immediately upon the bolt 24 coming in firing contact with the end of the barrel 20, either directly or through the interposed cartridge case, collar 42 engages abutment 40. The bolt 24 and the barrel 20 then move forward together by virtue of the momentum of the bolt 24. During the forward movement of the bolt 24 and barrel 20, the cartridge 68 is fired by means of an integral firing pin located in the face of the bolt 24 or by a separate firing pin 70 which is struck by the hammer of the trigger mechanism of the firearm 10. Upon firing of the cartridge 68, the bolt 24 is forced rearwardly against the force of the spring 48. Immediately thereafter, the barrel 20 is urged to return to its seated position against the abutment 40 by the same force of the spring 48 (see FIG. 3). The bolt 24 recoils rearwardly, while sliding the collar 42 along the guide rod 32. During recoil, the cartridge case 68 is extracted from the chamber and later ejected from the weapon by conventional means. When the bolt 24 reaches its full recoil position, the spring 48 forces the bolt 24 to again move forwardly to repeat the above steps, unless the bolt 24 is held in its full recoil position by means of the sear 66.

It should be appreciated from the above description that the basic action system 30 of the invention operates by what is commonly referred to as differential recoil, a description of which can be found in U. S. Pat. No. 4,019,423 issued to me, and the disclosure of which is hereby incorporated by reference. Moreover, the various components of the basic operating system 30 enables the system to operate with only one spring which functions both as a bolt spring and a barrel spring. Briefly summarizing, operation involves designing the mass and the closing velocity of the bolt 24 such that before the bolt 24 impacts against the barrel 20, the bolt 24 will have a forward momentum which depends on the firing recoil momentum and on the masses of the bolt and barrel. Upon impacting with the barrel 20, the momentum of the bolt 24 causes the barrel 20 to also move forwardly against the force of the spring 48. The impact of the bolt 24 on the barrel 20 tends to be of a type known as low coefficient of restitution or non-resilient impact. In this type of impact, the bolt 24 and barrel 20 do not tend to rebound after impact, but rather remain in contact. Thus, the bolt 24 and barrel 20 move substantially together immediately after the cartridge is fired, during the dangerous period when there is high pressure in the barrel. Since the bolt 24 at this time is effectively closed against the barrel 20, the bolt 24 supports the rear of the cartridge case, and the case is thereby prevented from being stretched unacceptably or ruptured because of the high pressure. After the bolt 24 and barrel 20 have moved forwardly for a short distance, the bolt 24 begins to decelerate in its forward movement due to the gas pressure in the barrel 20 acting on the bolt 24 through the rear of the cartridge case. The bolt 24 is eventually stopped by the gas pressure and then accelerated rearwardly by this pressure. Although the bolt 24 moves rearwardly at this time, the barrel 20 continues in its forward movement causing the bolt 24 and barrel 20 to move apart in opposite directions. When the force of the spring 48 overcomes the forward momentum of the barrel 20, the barrel 20 is returned to the rest position in which the lug 36 is seated against the abutment 40. From the foregoing, it should be appreciated that a portion of the recoil momentum produced in firing the cartridge is utilized in arresting the forward motion of the bolt and the remainder recoil momentum is utilized in returning the bolt to its initial position. Thus, since the forward movement of the barrel 20 is cushioned against the spring 48, neither the bolt 24 nor the barrel 20 have metal impact with the receiver 12. The receiver 12 is therefore subjected to only spring forces. This results in a low and relatively constant force rather than a succession of impacts as would be the case without the differential recoil effect. The stability of the gun is greatly improved.

Trigger Mechanism

The trigger mechanism 80 of the invention comprises a trigger 82, interrupter 84, selector 86, hammer link 88, and hammer/sear 90 which are operatively connected together to selectively provide for semi-automatic and fully automatic firing modes.

More particularly, the trigger 82 comprises a substantially L-shaped design having an elongated hole 92 in the corner thereof. The trigger 82 is pivotably connected to the receiver 12 by means of a trigger pin 94 which engages through hole 92. A trigger spring 96 is operatively connected to the trigger 82 to urge the trigger forwardly such that the trigger pin 94 is engaged in the rearward position of the elongated hole 92. The trigger 82 further comprises projections $T_1$ and $T_2$ which form the rearward end and the bottom end of the trigger 82. The hammer link 88 includes an elongated member, the rearward end of which is pivotably connected to the hammer/sear 90 by means of a pivot pin 98. A protuberance 100 extends from the upper surface of the hammer link 88 through a slot 102 formed within the track 104 on which the bolt 24 reciprocates. The forward end of the hammer link 88 further includes a projection $L_1$. The hammer/sear 90 is pivotably connected to the receiver 12 by means of a pin 106. A spring is connected about the pin 106 and engages the hammer link 88 and the hammer/sear 90 to urge them both upwardly toward the slot 102 in the track 104. It shall be noted that two separate springs may be utilized to urge the hammer link 88 and the hammer/sear 90 in their respective directions without departing from the spirit and scope of this invention. The length of hammer/sear 90 is designed such that the hammer/sear 90 will strike the firing pin 110 of the bolt 24 when the bolt 24 is in its fully forward position. A detent 112 is provided on the underside of the bolt 24 enabling the hammer/sear 90 to engage therein and hold the bolt 24 in its rearward seared position. A cam surface 113 is formed on the forward, underside of the bolt 24 for camming engagement with the protuberance 100 of the hammer/-link 88. The relative positions of the protuberance 100 and the cam surface 113 determines the timing of the hammer fall in the fully automatic mode, which will be discussed hereinafter in further detail.

The interrupter 84 comprises an elongated design having two arms 114 and 116 which extend substantially parallel to, yet off-set, from one another. The interrupter 84 is pivotably connected to the receiver 12 by means of a pivot pin 118. A spring 120 is provided for urging the second arm 116 upward within the receiver 12 for engagement with projection $T_2$ of the trigger 82. The interrupter 84 includes projection $I_1$,-located at the end of the first arm 114 and another projection $I_2$ located at the end of the other arm 116. The selector 86 includes a substantially half-cylindrical configuration which is rotatably positioned through the receiver 12. When the selector 86 is in the position shown in FIG. 1 (hereinafter referred to as "semi-automatic position"), the arm 114 of the interrupter 84 is able to pivot downwardly and engage the selector 86. Conversely, when the selector 86 is rotated 180°, the selector 86 is in the "fully automatic mode" such that arm 114 of the interrupter 84 is forced to remain in its upward position as shown in FIG. 1. It should be appreciated that many other selectors, such as slide selectors, may be substituted for the rotatable selector 86 without departing from the spirit and scope of the invention. Additionally, it shall be understood that selector 86 may include a three-position selector, with the other position being designed to prevent operation of the trigger 82 thereby creating a safety mechanism.

OPERATION OF TRIGGER MECHANISM

Figure 4:
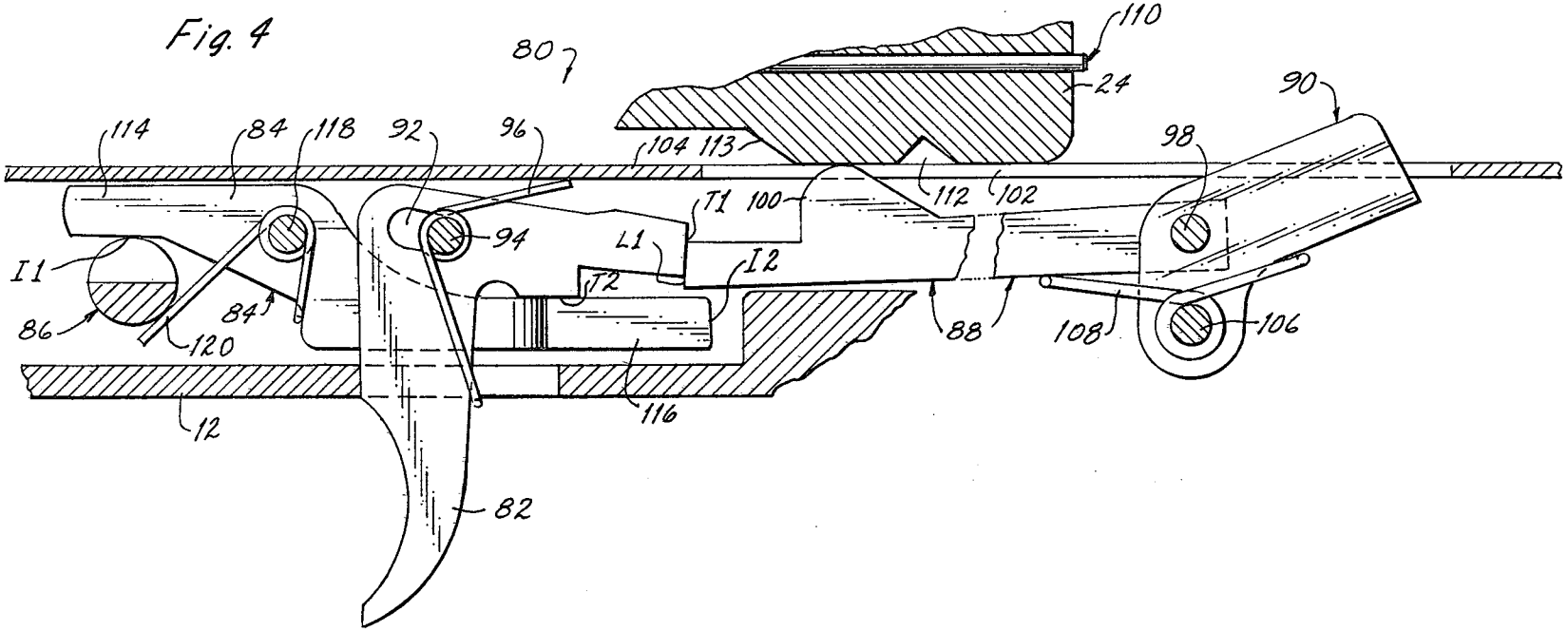
FIG. 4 is a schematic representation of the first embodiment of the trigger mechanism of the invention.

In the semi-automatic mode as shown in FIG. 4, it is seen that pulling on the trigger 82 causes it to rotate about the trigger pin 94 which in turn, raises projection $T_1$ above projection $L_1$. The hammer link 88 is now able to move forward by virtue of spring 108. As the hammer link 88 moves forward, the hammer/sear 90 rotates about pin 106 and strikes the firing pin 110 in the bolt 24, thereby firing the firearm.

The recoiling bolt 24 forces the hammer/sear 90 to rotate backward about pin 106 to a position beneath the slot 102 in the bolt track 104. Simultaneously, the hammer link 88 slides rearwardly beyond the projection $I_1$ of the interrupter 84. The hammer link 88 also rises due to the force exerted on it by spring 108. With the hammer/sear 90 in a fully down position such that the hammer link 88 is in a fully rearward position, projection $I_2$ of the interrupter 84 is moved upwardly by virtue of spring 120. Projection $I_2$ therefore engages projection $L_1$ of the hammer link 88. Since projection $I_2$ is located to the rear of projection $T_1$, the hammer/sear 90 is held far enough rearward and down to permit the bolt 24 to override it and close.

As the bolt 24 closes, it cams the hammer link 88 downwardly by means of the protrusion 100. But, as long as the trigger 82 is held rearwardly, projection $L_1$ of the hammer link 88 remains engaged on projection $I_2$ of the interrupter 84, thereby preventing the hammer/-sear 90 from pivoting and striking the firing pin 110. When the trigger 82 is released, the projection $T_2$ thereof forces arm 116 of the interrupter 84 to rotate downwardly and forces projection $L_1$ of the hammer link 88 to disengage projection $I_2$ of interrupter 84 and to engage projection $T_1$ of the trigger 82. At this point, the fire control mechanism 80 of the invention has been restored to the conditions shown in FIG. 4, and is ready for another cycle.

Figure 1:
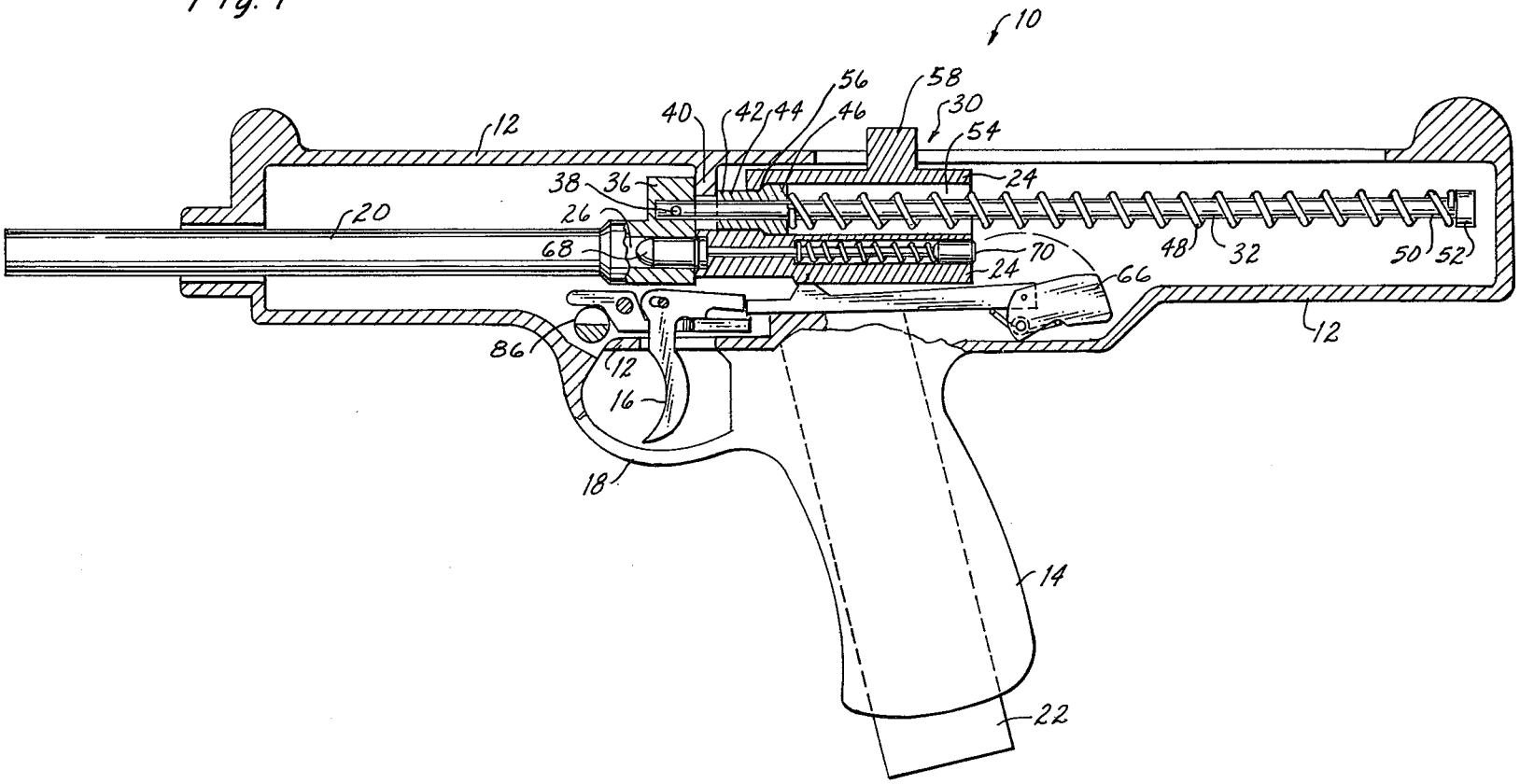
FIG. 1 is a partial cutaway view of a firearm having incorporated therein the basic action system and the trigger mechanism of the invention.
Figure 2:
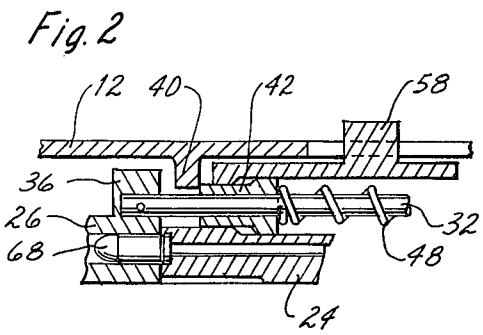
FIG. 2 is a partial cutaway view illustrating the bolt and barrel moving forwardly at the time of firing of the cartridge.
Figure 3:
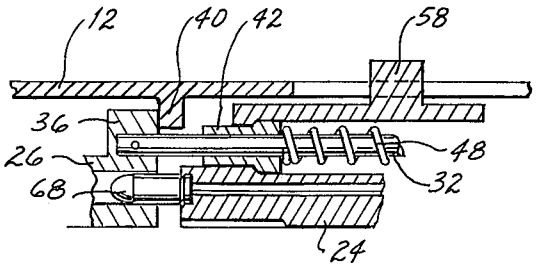
FIG. 3 is a partial cutaway view illustrating the bolt recoiling rearwardly after firing of the cartridge with the barrel having been returned to its seated position against the abutment by the force of the spring.

Rotation of the selector 86 180° forces the arm 116 of the interrupter 84 to remain in the position shown in FIG. 1. In other words, the interrupter 84 is locked into a non-engaging position. Assuming the bolt 24 is in a fully-forward, closed position as shown in FIG. 4, a pull on the trigger 82 will cause the hammer/sear 90 to pivot and strike the firing pin 110 by virtue of the fact that the hammer projection $L_1$ of the hammer link 88 slides under projection $T_1$ of the trigger 82, rather than becoming engaged therewith. As the bolt 24 recoils rearwardly, it pivots the hammer/sear 90 rearwardly but is caught thereby when the hammer/sear 90 engages into detent 112. With fire having been interrupted by release of the trigger 82, the hammer link 88 is in its upward position and projections $L_1$ and $T_1$ are slightly out of contact.

With the bolt 24 now being caught and held to the rear by the hammer/sear 90, full automatic fire is resumed by pulling the trigger 82 which causes it to rotate first about the trigger pin 94 and then move rearwardly a distance equal to the length of the elongated hole 92. As the trigger 82 moves straight rearwardly, projection $T_1$ of the trigger 82 engages projection $L_1$ of the hammer link 88 thereby forcing the hammer link 88 rearwardly. This in turn pivots the hammer/sear 90 to its fully recessed position below the slot 102 in the bolt track 104. The bolt 24 is therefore freed and allowed to move forward and close.

While the bolt 24 is closing, the hammer link 88 remains in its up position with projection $L_1$ engaged with projection $T_1$ of the trigger 82 thereby holding the hammer/sear 90 in its fully-down, cocked position. When the bolt 24 reaches its closed position, the cam surface 122 thereof engages protuberance 100 of the interrupter 84 forcing the interrupter 84 downwardly.

This causes projection $L_1$ of the interrupter 84 to disengage from projection $T_1$ of the trigger 82, thereby freeing the hammer link 88 to move forwardly and the hammer/sear 90 to pivot and strike the firing pin 70. It should be appreciated that the falling of the hammer/sear 90 depends upon the relative locations of the cam surface 122 of the bolt 24 and the protuberance 100 on the hammer link 88. It should also be appreciated that the timing of the hammer fall is controlled only by the motion of the closing bolt 24.

When the trigger mechanism 80 has been operating in the fully automatic mode, and the selector 86 is changed to its semi-automatic position, the interrupter 84 is freed to operate, in which case the first round will fire from the open-bolt position as described in fully automatic mode, but the interrupter 84 will allow the bolt 24 to override the hammer/sear 90 on the succeeding round, thereby allowing the fire-control mechanism 80 to return to the closed-bolt, semi-automatic mode as described previously.

It should be appreciated that, in the semi-automatic mode, the trigger pull is a simple, single stage motion. The engaging projections of the various components are typically located at the ends thereof, thereby facilitating easy finishing operations to obtain a smooth trigger pull. It should also be appreciated that, in the fully automatic mode, the trigger pull includes two stages, the first stage being relatively light as the trigger 82 simply rotates against its spring 96. The second stage or final pull is relatively heavier, in the conventional manner, as the trigger 82 moves straight to the rear against the force of the hammer/sear spring 108. Selecting a particular weight of pull is merely a matter of geometry and spring design.

Figure 5:
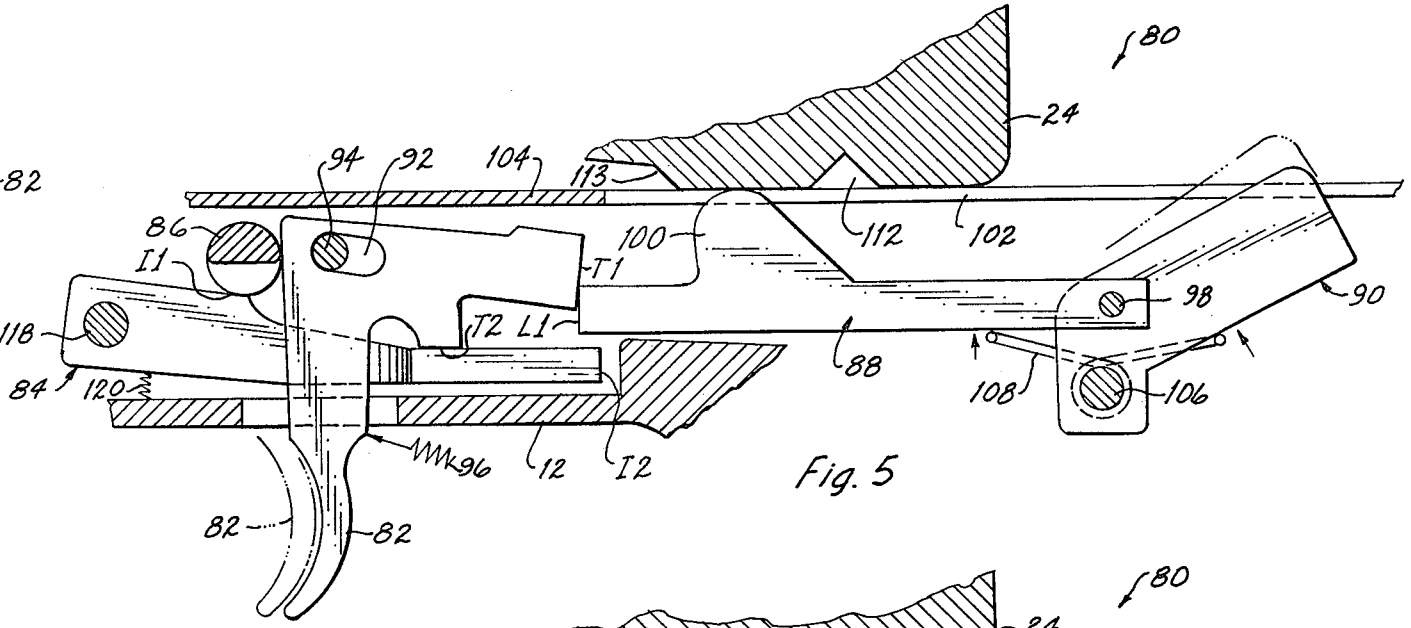
FIGS. 5 and 5A are schematic representations of the second embodiment of the trigger mechanism of the invention.
Figure 6:
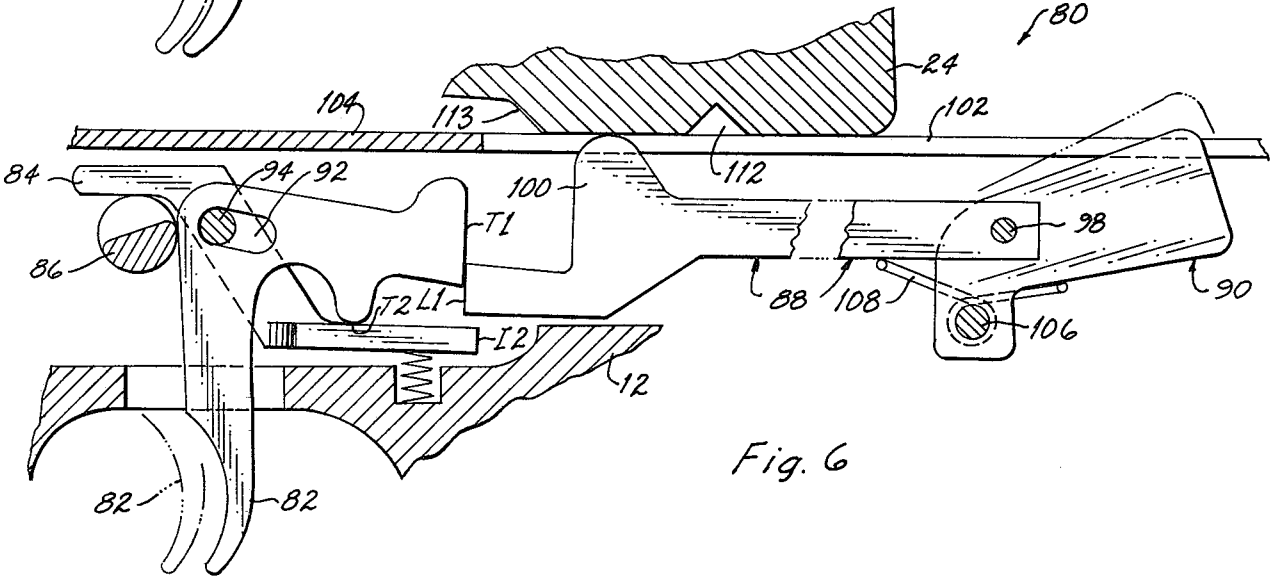
FIGS. 6 and 6A are schematic representations of the third embodiment of the trigger mechanism of the invention; and, FIGS. 7 and 7A are schematic representations of the fourth embodiment of the invention.
Figure 7:
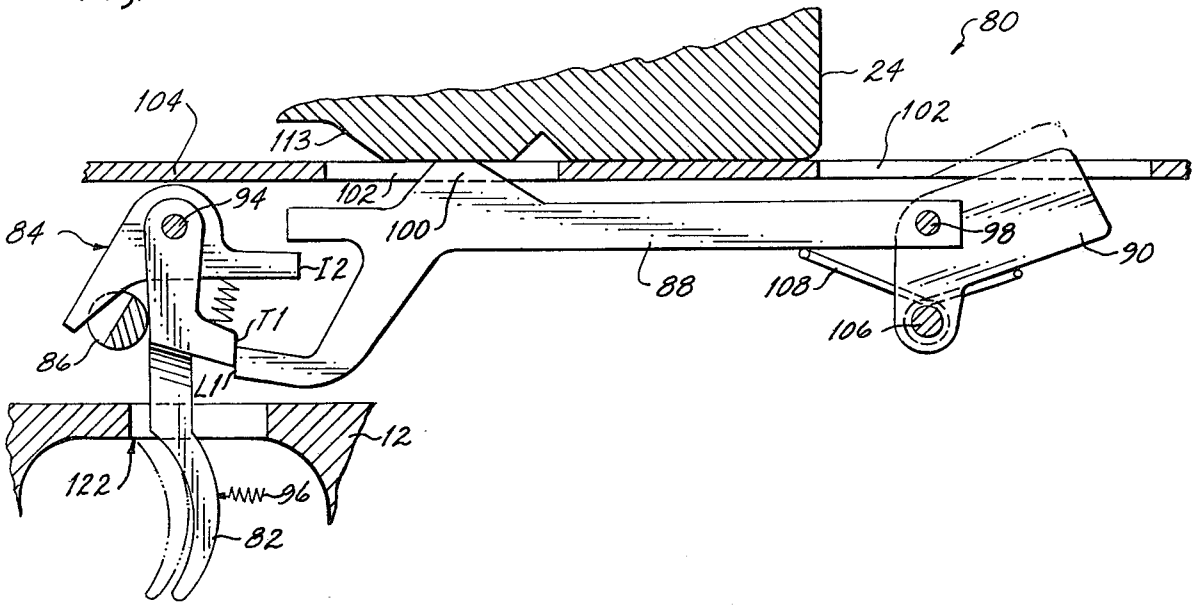

It should be apparent that it is possible, in the semi-automatic mode, to inadvertently sear the bolt 24 if the trigger 82 is released immediately after the firing of the gun. FIGS. 5, 6, and 7 illustrate three other embodiments of the trigger mechanism 80 which eliminate the possibility of inadvertent open bolt searing when firing in the semi-automatic mode.

Figure 5A:
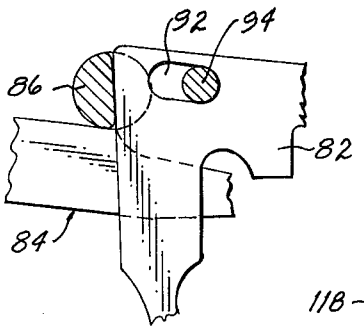

Specifically, referring to FIGS. 5 and 5*a*, it is seen that the interrupter 84 is redesigned to include an elongated configuration, the forward end of which is pivotably connected to the receiver 12 by means of the pin 118. A spring 120 is still utilized to force the interrupter 84 into its upward, engaging position. With the selector in the semi-automatic mode as shown in FIG. 5, the trigger 82 and the hammer link 88 are held rearwardly, thereby preventing the hammer/sear 90 from rising above the slot 102 in the bolt track 104. Inadvertent rear searing is therefore prevented at all times with the selector in the semi-automatic mode. Referring now to FIG. 5*a*, it is seen that upon rotating the selector 86 to the fully automatic position, the selector 86 allows the trigger 82 and the hammer link 88 to move forwardly a distance such that the hammer/sear 90 rises to a position above the slot 102 in the bolt track 104, as represented in phantom in FIG. 5. In this position, the hammer/sear 90 can engage and hold the bolt rearwardly in the searing position.

Figure 6A:
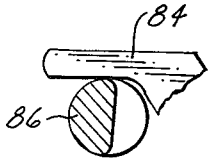

FIGS. 6 and 6*a* illustrate the third embodiment of the trigger mechanism 80 of the invention which operates in substantially the same manner as the second embodiment, but designed primarily for the purpose of eliminating some of the component parts thereof. Specifically, it is seen that both the interrupter 84 and the trigger 82 are pivotably connected to the receiver 12 by the same pin 94. This reduces, by one, the number of component parts of the fire control mechanism 80.

Figure 7A:
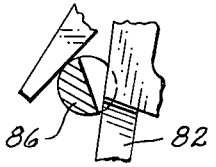

FIGS. 7 and 7*a* illustrate the fourth embodiment of the trigger mechanism 80. More particularly, this embodiment of the trigger mechanism 80 operates on the same general principles as the second and third embodiments described above, but with the added feature of having a trigger 82 which moves in a perfectly rotary or pivoting motion. As with the second and third embodiments, inadvertent rear searing of the bolt 24 during semi-automatic fire is avoided by preventing the hammer/sear 90 from rising, in the semi-automatic mode, far enough to engage and hold the bolt 24 in the searing position. In the fully automatic mode, the position of the selector 86 permits the trigger 82 to pivot slightly forward and rest on the stop surface 122 of the receiver 12. This allows the hammer/sear 90 to move to the fully automatic position as shown in phantom, where it can engage and retain the bolt 24. At the same time, the selector 86 cams the interruptor 84 out of operation by positioning it so that projection $I_2$ cannot engage projection $L_1$ of the hammer link 88. It is noted that the bolt 24 is precluded from becoming inadvertently seared in the semi-automatic mode because of the fact that the hammer link 88 and correspondingly, the hammer/sear 90, are moved to their non-searing position while the trigger 82 is being pulled, until the projection $T_1$ of the trigger disengages projection $L_1$ of the hammer link 88.

It is noted that with respect to the second, the third, and the fourth embodiments of the trigger mechanism 80, that if the bolt 24 is in its fully automatic, seared position, and the selector 86 is moved to its semi-automatic position, the hammer/sear 90 will release the bolt 24 enabling the bolt 24 to close. However, the hammer/sear 90 will be held rearwardly in its cocked position due to the face that the hammer link 88 will be precluded from moving sufficiently forward. Accordingly, the hammer/sear 90 will not be released to strike the firing pin 110 by the action of changing from the fully automatic to the semi-automatic mode.

I claim:

1. A trigger mechanism for a firearm, comprising in combination:

a hammer/sear pivotably positionable to a firing position, a searing position, and recessed position;

first means for urging said hammer/sear from said recessed position to said searing position, and further to said firing position;

a hammer link moveable to and from a rearward position, an intermediate position, and a forward position;

said hammer link pivotably connected to said hammer/sear to lock said hammer/sear into said recessed position when said hammer link is in said intermediate position, to permit said first urging means to pivot said hammer/sear to said searing position when said hammer link is in said forward position, and to permit said first urging means to pivot said hammer/sear to said firing position when said hammer link is in said forward position;

second means for urging said hammer link upwardly;

a trigger pivotably connected to the firearm, said trigger including a projection which engages said hammer link to prevent said hammer link from moving forward until said trigger is pulled;

means for urging said trigger in a direction opposite to that in which said trigger is pulled;

an interruptor for holding said hammer link in the fully rearwardly position when said trigger is pulled; and a selector in engagement with said interruptor to lock said interruptor in and out of operable engagement with said hammer link.

2. A trigger mechanism for a firearm operable in a fully automatic mode and a semi-automatic mode, said firearm including a reciprocating bolt having a firing pin, comprising in combination:

a hammer/sear positionable in a firing position for impacting the firing pin, a searing position for searing engagement with the bolt, and a recessed position;

first means for urging said hammer/sear from said recessed position to said searing position and from said searing position to said firing position;

a hammer link having a first end and a second end, and a protrusion for camming engagement with the bolt, said hammer link moveable to and from a forward position, an intermediate position, and a rearward position;

first means for pivotably connecting said first end of said hammer link to said hammer/sear, whereby movement of said hammer link into said rearward, intermediate and forward positions permits movement of said hammer/sear into said recessed, searing and firing positions, respectively;

second means for urging said hammer link toward the bolt for camming engagement therewith;

a trigger operable to and from a non-firing position and a pulled, firing position, including a first projection for operative engagement with said second end of said hammer link, said first projection having a length equal to that required to maintain said hammer link into said intermediate position when engaged therewith when operating in the semi-automatic mode and when said trigger is in said non-firing position;

second means for operatively connecting said trigger to the firearm to permit said trigger to move said hammer link from said intermediate position to said rearward position when said trigger is moved from said non-firing position to said pulled, firing position;

third means for urging said trigger into said non-firing position;

an interruptor including a second projection for operative engagement with said second end of said hammer link, said second projection having a length equal to that required to maintain said hammer link in said rearward position when said second projection is engaged with said second end;

third means for operatively connecting said interruptor to the firearm to permit movement of said second projection into and out of engagement with said second end of said hammer link;

fourth means for urging said interruptor into position for engagement with said second end of said hammer link;

a selector moveable to and from an automatic firing position and a semi-automatic firing position; and fourth means for operatively connecting said selector to said interruptor to prevent and to permit movement of said interruptor into engagement with said second end of said hammer link when said selector is in said automatic firing position and said semi-automatic firing position, respectively.

3. The trigger mechanism as set forth in claim 2, wherein said trigger includes a third projection for engagement with said interruptor to move said interruptor from the position for engagement with the second end of said hammer link when said selector is said semi-automatic firing position and when said trigger is released and urged to move from said pulled, firing position to said non-firing position.

4. The trigger mechanism as set forth in claim 3, wherein said second connecting means comprises a slot formed within said trigger and trigger pin connected to the firearm and extending into said slot, whereby said trigger is rotatably and then longitudinally moveable about said trigger pin.

5. The trigger mechanism as set forth in claim 4, wherein said third urging means further includes means for urging said trigger fully forwardly away from said hammer link with said trigger pin being positioned in the rearwardmost portion of said slot.

6. The trigger as set forth in claim 5, wherein said fourth connecting means comprises said selector having a substantially semi-cylindrical portion which is rotatably journaled adjacent to a fourth projection emanating from said interruptor, whereby semi-cylindrical portion engages and disengages said fourth projection when said selector is in said automatic firing position and said semi-automatic firing position, respectively.

7. The trigger mechanism as set forth in claim 6, wherein said selector is further defined as being positioned in operative engagement with said trigger such that said first projection of said trigger is positioned rearwardly toward said hammer link to maintain said hammer link in said rearward position when said first projection is engaged with said second end and when said selector is in said semi-automatic firing position.

8. The trigger mechanism as set forth in claim 2, wherein said second end of said hammer link comprises a forked configuration having a first forked end for engagement with said first projection of said trigger and a second forked end for engagement with said second projection of said interruptor, wherein said second connecting means and said third connecting means comprise pivotally connecting said trigger and said interruptor to the firearm by means of a trigger pin, and wherein said fourth connecting means comprises positioning said selector having a substantially semi-cylindrical portion adjacent to a fourth projection emanating from said interruptor such that said semi-cylindrical portion engages said fourth projection to maintain said second projection of said interruptor from engagement with said second forked end when said selector is in said automatic firing position.

9. The firearm as set forth in claim 8, wherein said selector is further defined as being positioned adjacent to said trigger such that said trigger and correspondingly, said first projection are moved rearwardly when said selector is in said automatic firing position thereby moving said hammer link to said rearward position when said first projection is engaged with said first forked end.

* * * * *